US006709712B2

(12) United States Patent
Chappa et al.

(10) Patent No.: US 6,709,712 B2
(45) Date of Patent: Mar. 23, 2004

(54) COATING METHOD

(75) Inventors: Ralph A. Chappa, Prior Lake, MN (US); Steven J. Porter, Minnetonka, MN (US)

(73) Assignee: Surmodics, Inc., Eden Prairie, MN (US)

( * ) Notice: Subject to any disclaimer, the term of this patent is extended or adjusted under 35 U.S.C. 154(b) by 0 days.

(21) Appl. No.: 10/429,019

(22) Filed: May 1, 2003

(65) Prior Publication Data

US 2003/0190420 A1 Oct. 9, 2003

Related U.S. Application Data

(62) Division of application No. 09/657,885, filed on Sep. 8, 2000, now Pat. No. 6,562,136.

(51) Int. Cl.[7] ..... B05D 1/02

(52) U.S. Cl. ..... 427/425; 118/224; 118/240; 118/242; 118/308; 118/319; 118/500; 269/55; 427/299; 427/346

(58) Field of Search ..... 118/224, 240, 118/242, 308, 319, 500; 269/55; 427/299, 346, 425

(56) References Cited

U.S. PATENT DOCUMENTS

| | | | |
|---|---|---|---|
| 2,821,158 | A | 1/1958 | Brown et al. |
| 3,699,917 | A | 10/1972 | Deverse et al. |
| 3,936,549 | A | 2/1976 | Kohler et al. |
| 4,082,870 | A | 4/1978 | Yenni |
| 4,616,593 | A | 10/1986 | Kawamura et al. |
| 5,049,404 | A | 9/1991 | Kisler et al. |
| 5,069,940 | A | 12/1991 | Wenrick |
| 5,254,164 | A | 10/1993 | Masahumi |
| 5,421,979 | A | 6/1995 | Stevenson |
| 5,630,879 | A | 5/1997 | Eichmann et al. |
| 5,637,460 | A | 6/1997 | Swan et al. |
| 5,714,360 | A | 2/1998 | Swan et al. |
| 5,849,359 | A | 12/1998 | Burns et al. |
| 5,913,653 | A | 6/1999 | Kempf |
| 5,976,256 | A | 11/1999 | Kawano |
| 6,056,998 | A | 5/2000 | Fujimoto |
| 6,562,136 | B1 | 5/2003 | Chappa et al. |

FOREIGN PATENT DOCUMENTS

| | | |
|---|---|---|
| FR | 1304457 | 8/1962 |
| GB | 104464 | 3/1917 |
| GB | 525373 | 8/1940 |
| WO | WO 93/00174 | 1/1993 |
| WO | WO 99/55396 | 11/1999 |

*Primary Examiner*—Bernard Pianalto
(74) *Attorney, Agent, or Firm*—Merchant & Gould P.C.

(57) ABSTRACT

The invention provides a device for holding a substrate during deposition processes that includes a rotation member rotatable about a first, central axis, and a plurality of substrate holders positioned on the rotation member, the substrate holders being rotatable about second axes. In another aspect, the invention provides a method of applying a substantially uniform coating on a substrate including the steps of providing a device of the invention; mounting a substrate onto the substrate mounts; providing at least one substrate coating station in spaced relation to the substrate mounts; rotating the rotation member about a central axis to position one or more of the substrate mounts at the substrate coating station; supplying the coating through the nozzle; moving the nozzle of the coating station in a direction parallel to the substrate at a predetermined rate to apply a uniform coating on the substrate; and rotating the substrate mounts about the second axes during the coating process.

3 Claims, 8 Drawing Sheets

COATING METHOD

This application is a divisional of application Ser. No. 09/657,885, filed Sep. 8, 2000, U.S. Pat. No. 6,562,136, which application is incorporated herein by reference.

FIELD OF THE INVENTION

The invention relates to a coating apparatus and method for applying a uniform coating on a substrate. More specifically, the invention relates to an apparatus and method for providing a uniform coating on a substrate having a surface geometry, such as a medical device.

BACKGROUND OF THE INVENTION

Medical devices are becoming increasingly complex in terms of function and geometry. Traditional coating methods, such as dip coating, are often undesirable for coating these complex geometries since coating solution may get entrapped in the device structure. This entrapped solution may cause webbing or bridging of the coating solution and may hinder the device function.

Spray coating techniques have also been used to apply coatings to medical devices. However, current methods of spray coating have introduced operator error, and have resulted in reduced coating consistency and reduced coating efficiency.

SUMMARY OF THE INVENTION

The invention provides a device and method for applying a coating onto a substrate having surface geometry. The invention is particularly useful for such substrates as medical devices, since such devices are often relatively small in size and can include complex surface configurations. Preferably, the invention is used to coat such medical devices as stents or other devices involving coils, coiled portions or cylinders having cut stent patterns.

A preferred device of the invention includes a rotation member rotatable about a central axis; a plurality of substrate mounts positioned on the rotation member, the substrate mounts being rotatable about second axes; and a drive arrangement for rotating the rotation member about the central axis and rotating the substrate mounts about the second axes. In one embodiment, the rotation member is a wheel. In one embodiment, the second axes extend radially from the central axes, and the drive arrangement rotates the substrate mounts about radial axes. In another aspect, the device of the invention includes a plurality of substrate mounts that are rotatable about second axes that are parallel to the central axis.

A preferred method of the invention includes the following steps. A substrate holder is provided that includes a rotation member rotatable about a central axis, a plurality of substrate mounts positioned on the rotation member, and a drive arrangement for rotating the rotation member about a central axis and rotating the substrate mounts about radial axes. At least one coating station is provided adjacent to the rotation member, so that substrate mounts can be passed in proximity to the coating station or stations. The coating station includes a nozzle for delivery of a coating solution to the substrate surface, and a solution delivery channel for delivery of the coating solution from a source to the nozzle. The substrates to be coated are mounted onto the substrate mounts, and the rotation member is rotated about its central axis to position one or more substrates at the coating station. The substrate mounts are rotated about the radial axes to rotate the substrates at a uniform rate during the coating process. During the coating process, the nozzle of the coating station is moved in a direction parallel to the substrate at a predetermined rate and is positioned a predetermined distance from the substrate to form a uniform coating on the substrate.

The invention provides a combination of advantages, including the ability to adjust or accommodate for surface geometries of a substrate to be coated, as well as the ability to provide substantially uniform coatings on such substrates. The invention eliminates human factors in the coating system, and allows for increased throughput of coated substrates. Further, the invention provides a reduction of coating solution waste during application of one or more coating solutions. According to the invention, substrates mounted on the rotation member can be expeditiously moved through a coating zone in sequence by the rotation of the rotation member, thereby reducing overall processing time. Additionally, the rotation of the substrate about second axes (e.g., radial axes or axes that are parallel to the central axis) during the coating process assists in achieving a uniform coating on the substrate.

The invention provides a device that is easy to use. The substrate mounts can be removable, so that an operator can easily insert and remove the substrates without disassembling the apparatus. The invention also eliminates variability in such parameters as coating thickness that can result from variations in substrate positioning on the holding apparatus. The invention allows positioning of the substrate in a manner that is substantially parallel to the coating station for coating.

DETAILED DESCRIPTION

One aspect of the present invention relates to a device for holding a substrate that includes a rotation member rotatable about a first, central axis, a plurality of substrate mounts positioned on the rotation member, the substrate mounts being rotatable about second axes, and a drive arrangement for rotating the rotation member about a central axis and rotating the substrate mounts about second axes. Preferably, the drive arrangement comprises a first drive arrangement and a second drive arrangement. In a preferred embodiment, the first drive arrangement drives rotation of the rotation member, while the second drive arrangement drives rotation of the substrate mounts. The invention provides a substrate holder that allows for the application of a substantially uniform coating on a substrate, such as a medical device. In use, the substrate projects from the rotation member and is rotated about a second axis during the coating application. Preferably, the substrate to be coated is rotated by the rotation member about a central axis to position the substrate within a coating zone. Once within the coating zone, the substrate is preferably rotated about a second axis to allow for the application of a uniform coating.

Elements in common among the embodiments shown in the figures are numbered identically, with the addition of a letter to distinguish the second embodiment (e.g., 4 and 4*a* to distinguish embodiments of element identified by numeral 4 in the figures), and such elements need not be separately discussed.

Figure 1:
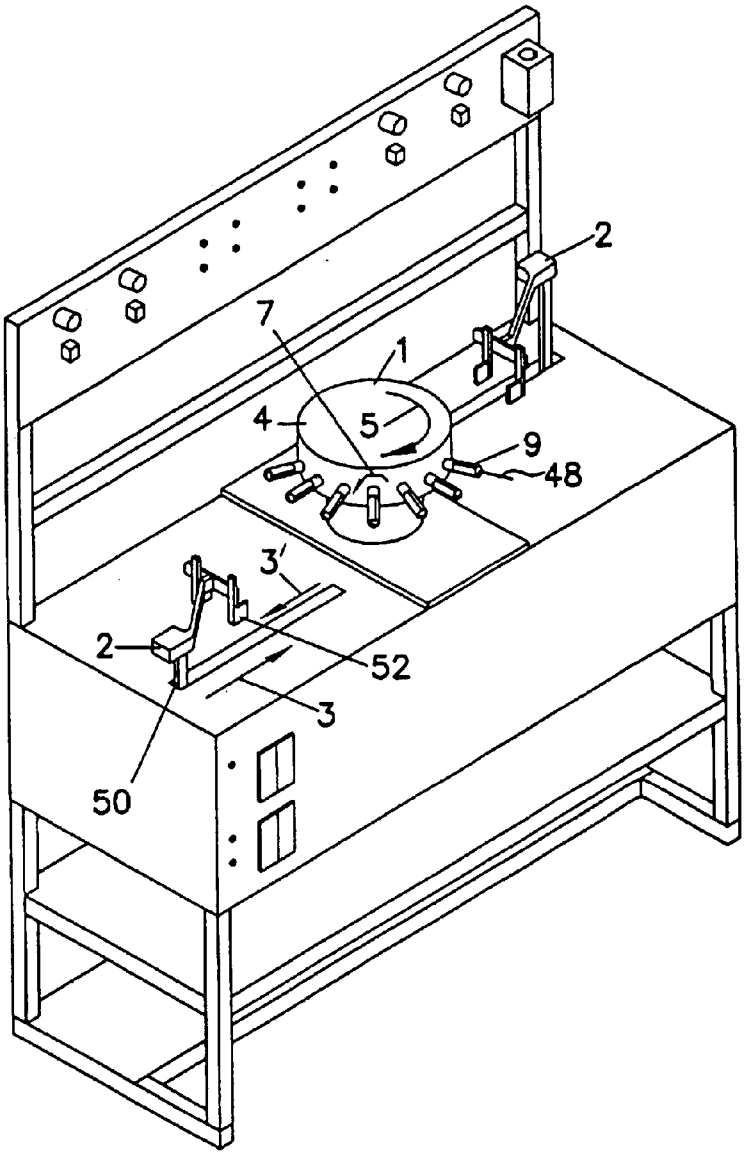
FIG. 1 shows a perspective view of a preferred embodiment of the invention, including a substrate holder and coating stations.
Figure 2:
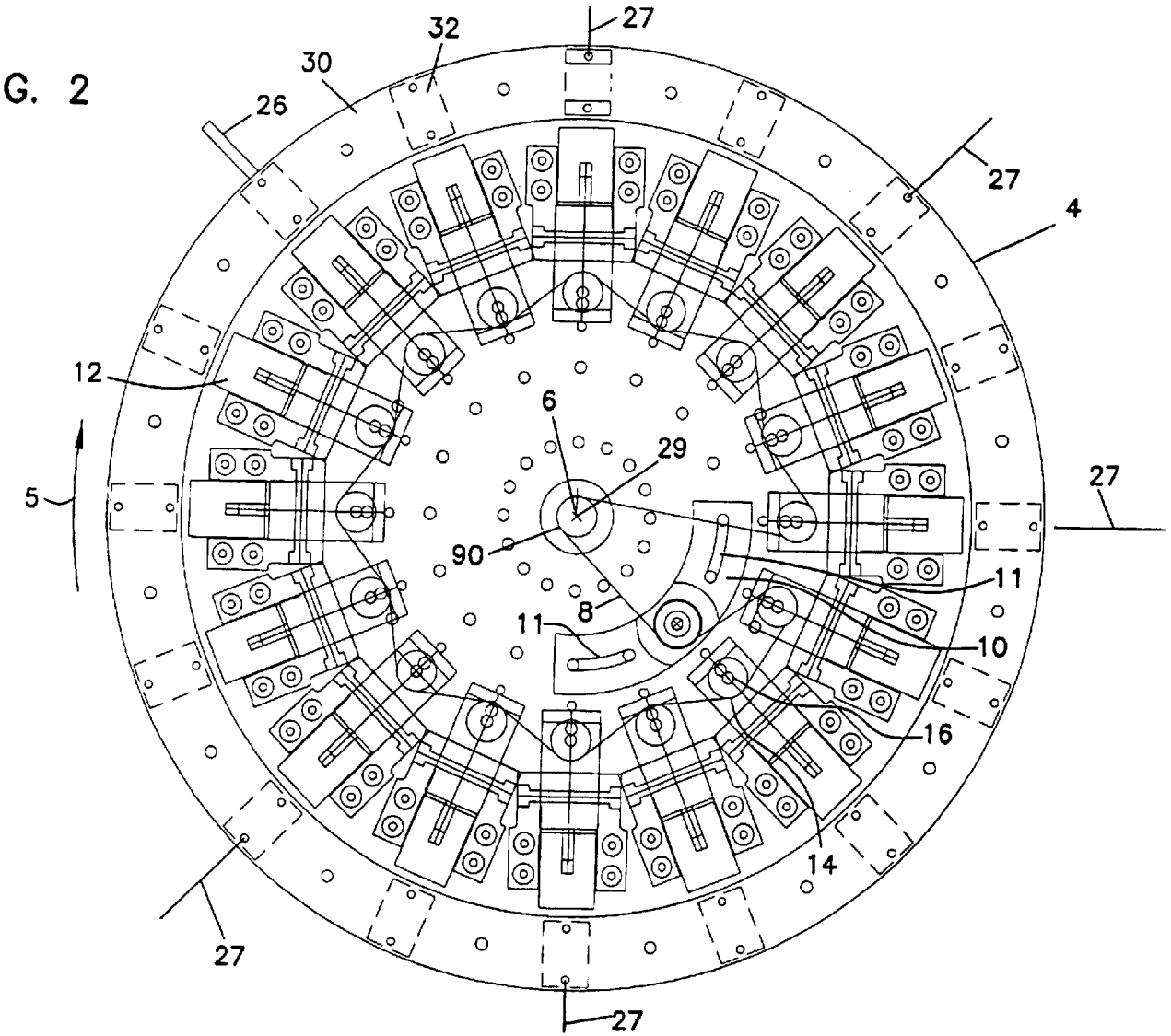
FIG. 2 shows a top cross-sectional view of the wheel of the embodiment of FIG. 1.

The invention will be described generally with reference to FIGS. 1 and 2. FIG. 1 depicts one embodiment of a device for holding a substrate that is indicated generally as 1. In the embodiment shown in FIG. 1, the invention includes a rotation member 4 and a coating station 2 that is movable in direction of arrows 3 and 3', which is toward and away from the rotation member 4, respectively. Rotation member 4 is rotatable in direction of arrow 5 and includes substrate mounts 9 that project radially from the rotation member 4, the substrate mounts 9 being rotatable in direction of arrow 7. Substrates 48 are coupled with the substrate mounts 9 for application of a coating. Referring to FIG. 2, the rotation member 4 can be provided as a wheel that is rotatable about a central axis 29 (i.e., in direction of arrow 5). Substrate mount 9 includes a shaft 26 and is rotatable about radial axes 27 (which is in direction of arrow 7 shown in FIG. 1).

The invention will now be described in more detail.

Rotation Member

Figure 6:
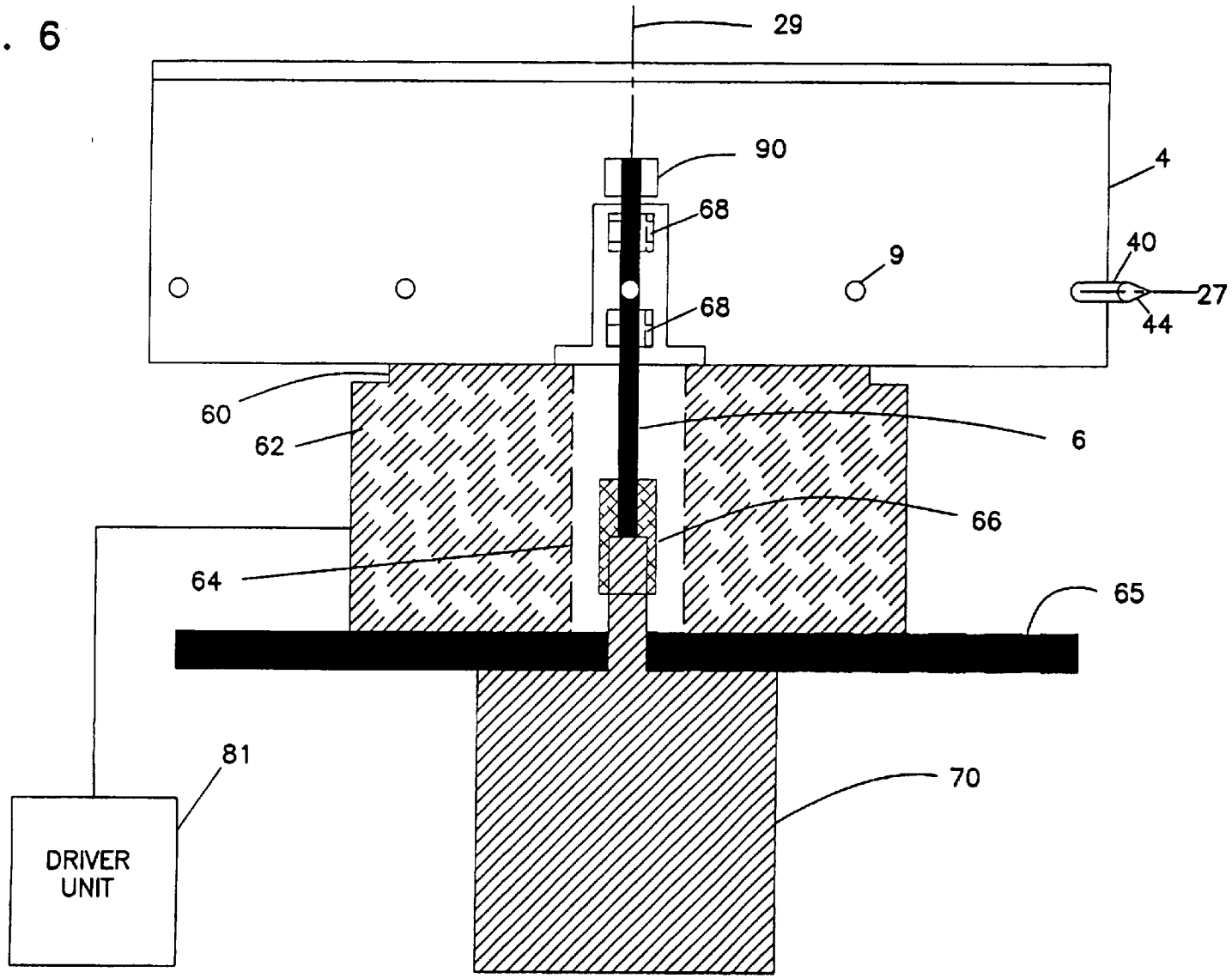
FIG. 6 shows a cross-sectional view of a preferred embodiment of the drive arrangement and wheel of the invention.

FIG. 2 shows one embodiment of the rotation member in the form of a wheel 4 according to the invention. In a preferred embodiment, the wheel 4 is rotatably driven by a motor 62 (shown in FIG. 6) about its central axis 29, in direction of arrow 5. Rotation of the motor 62 is preferably controlled by a driver unit 81 (FIG. 6). The wheel can be provided in any suitable dimensions, to accommodate the desired number of substrates to be coated and to fit into a total area for the coating operations, such as a fume hood.

Figure 8:
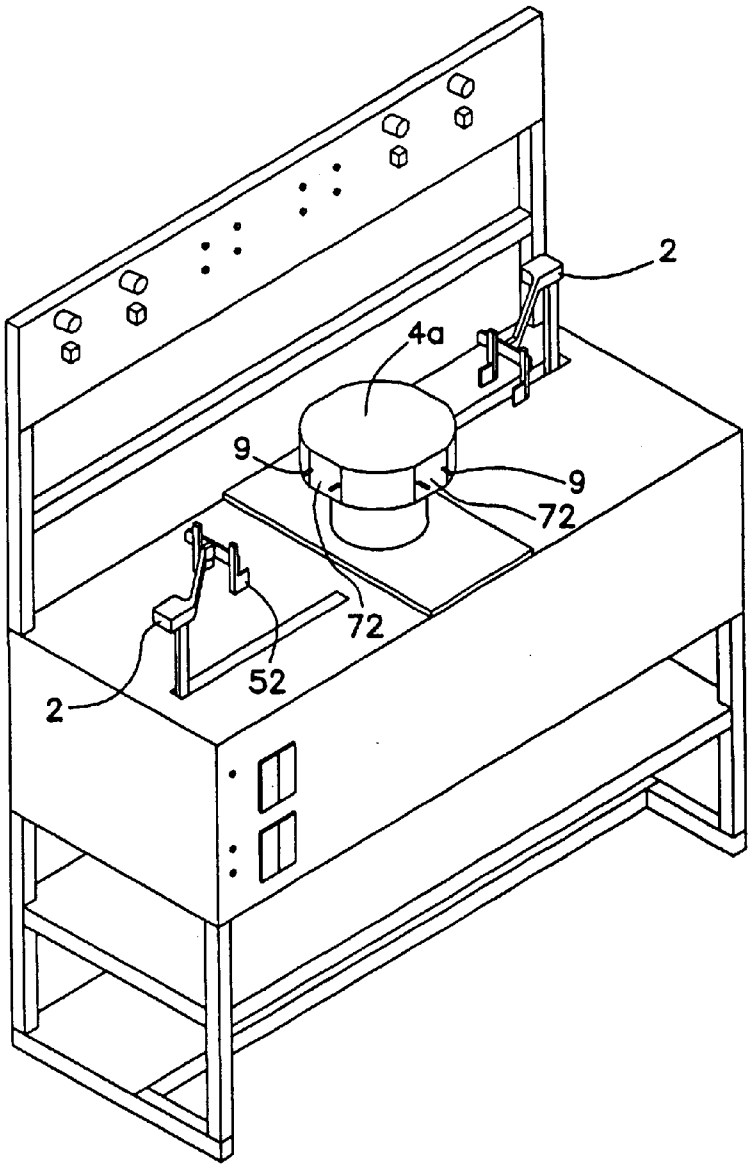
FIG. 8 shows a perspective view of an alternative embodiment of the rotation member of the invention.

FIG. 8 shows another embodiment of the wheel, indicated as 4*a*. In this embodiment, portions of the rim of the wheel are flattened to produce portions 72 that include substrate mounts 9. While the figure depicts two such substrate mounts 9 in each portion 72, it is understood that any suitable number of substrate mounts 9 can be provided within each portion 72 of the wheel 4*a*. The dimensions of each portion 72 can be adjusted to contain the number of desired substrate mounts 9 and will be determined by such factors as the diameter of the nozzle used in connection with the coating station, the width or diameter of the substrate to be coated using the device, the size of the coating zone, and the like. Further, any number of portions 72 can be provided on wheel 4*a*, depending upon the desired use.

The embodiment shown in FIG. 8 has been found to be particularly useful when coating relatively long substrates. The use of flattened portions 72 allows substrates to be mounted on wheel 4*a* in a manner that is parallel to the nozzle 52 of coating station 2. In this embodiment, substrates extend from the wheel 4*a* in parallel fashion, and the substrates are lined up more closely in line with nozzle 52 of the coating station. This embodiment provides a combination of advantages, such as a more uniform coating along the length of the (relatively long) substrate, as well as reduced waste of coating solution during the application process. This embodiment can be contrasted with the wheel 4 shown in FIGS. 1 and 2, where substrate mounts 9 extend from the rounded periphery of the wheel 4 and therefore are not aligned in a parallel manner with respect to each other.

It is understood that the rotation member can be provided in any suitable configuration, such as circular (e.g., a wheel as depicted in FIGS. 1 and 2), square, rectangular, or other, to achieve the purposes herein described. In one such alternative embodiment, for example, the rotation member is provided in the form of a square member including an equal number of substrate mounts on each peripheral side of the square. Any number of substrate mounts can be provided on each such face or side of the rotatable member, and the number of substrate mounts can be determined, for example, by the number of nozzles contained within each coating station, the distance between coating stations, overall dimensions of the device, dimensions of each substrate to be coated, and the like.

Substrate Mounts

Referring to FIG. 1, the substrate mounts 9 of the device 1 are positioned around the outer periphery of the rotation member 4. Preferably, the substrate mounts 9 mount the substrate 48 onto the wheel in such a manner that the substrate is a predetermined distance from the coating station and is positioned substantially horizontally for application of a coating material from the coating station.

Figure 5:
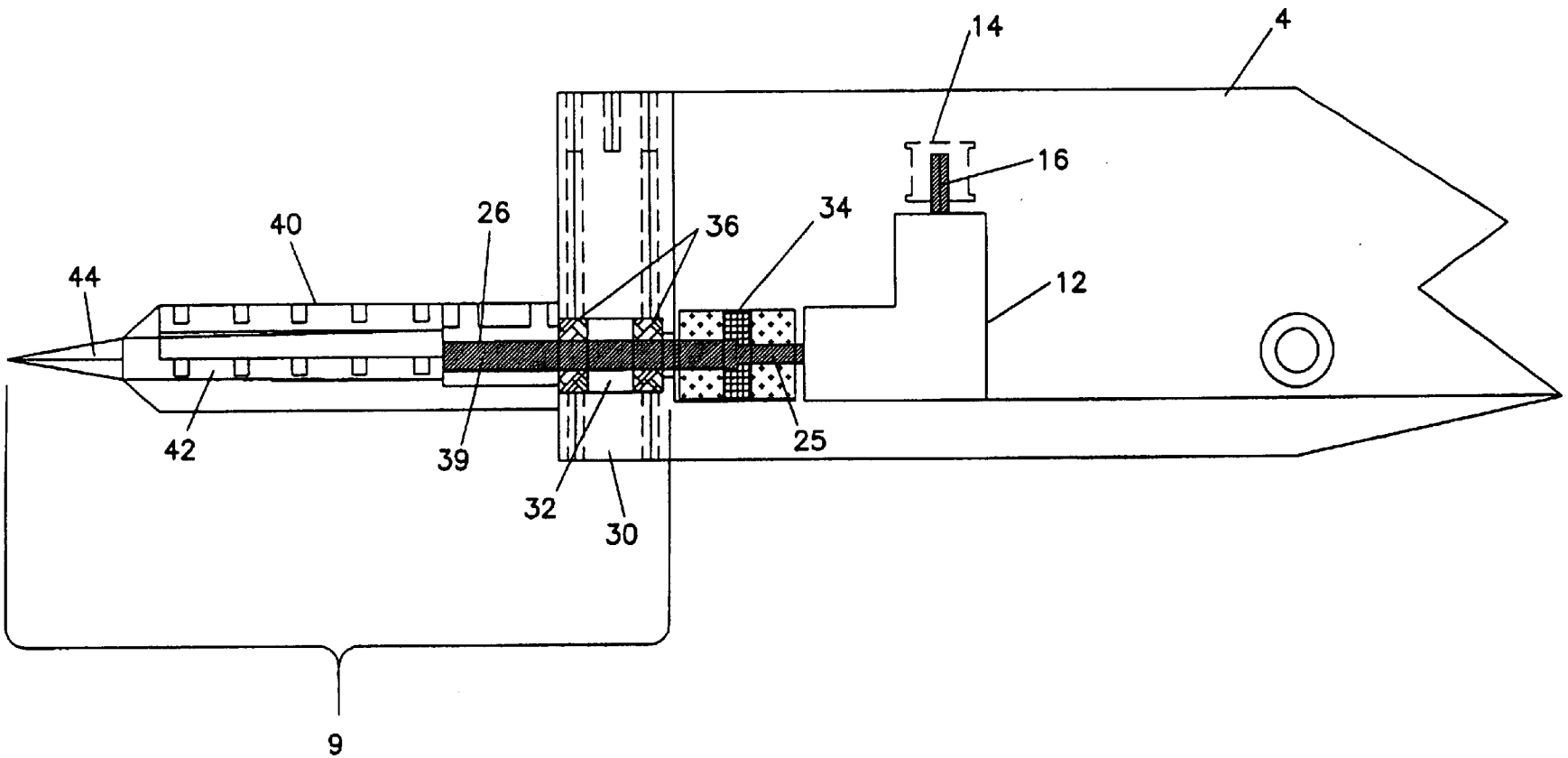
FIG. 5 shows a cross-sectional side view of the embodiment shown in FIG. 1, showing the wheel, and the right angle drive coupled to the substrate mount.

As shown in FIGS. 1, 2 and 5, the substrate mounts 9 project radially from the wheel 4 and are rotatable about radial axes 27. In a preferred embodiment, substrate mounts 9 include a shaft 26, a gripper carrier 40 and a substrate gripper 44. Shaft 26 projects from the periphery of the wheel 4 and engages the gripper carrier 40. Gripper carrier 40 is thus configured to be seated onto the shaft 26 and is frictionally held in place. In one embodiment shown in FIG. 5, gripper carrier 40 includes a chamber 39 for receiving the shaft 26. Other configurations of the shaft 26 and gripper carrier 40 can be substituted for that shown in the figure to achieve the same purpose. Additional securement of the gripper carrier 40 on the shaft 26 can be provided in the form of screws, magnets, pins, clamps, and the like. Preferably, the gripper carrier 40 is removable from the wheel 4, to allow the user to remove the gripper carrier 40 for insertion or removal of the substrate gripper 44 (discussed in more detail below) and substrate 48. The gripper carrier 40 can then be re-mounted on the wheel 4 for the coating operation.

A variety of configurations can be used for the gripper carrier 40 of the invention, while still utilizing one wheel 4. For example, the gripper carrier 40 can be configured to receive a medical device such as a stent, or it can be configured to receive a larger device with different dimensions. At the same time, the gripper carrier 40 can preferably be configured so that it has a standard (e.g., universally sized) chamber 39 for mounting onto the wheel, as described in more detail below, to allow the user to choose a particular gripper carrier 40 for a particular application without having to use a different wheel 4. The invention thus preferably provides a rotation member that is adaptable to be used to coat any suitable substrate, by simply changing the gripper carriers used in connection with the rotation member.

In yet another embodiment, gripper carrier 40 does not comprise a separable element of the device. Gripper carrier 40 can be provided as a part of the rotation member (e.g., wheel) or as part of the substrate gripper 44. One of skill in the art, given the teachings herein, could readily modify the device to provide the gripper carrier 40 as a part of either the rotation member or the substrate gripper 44.

Figure 4:
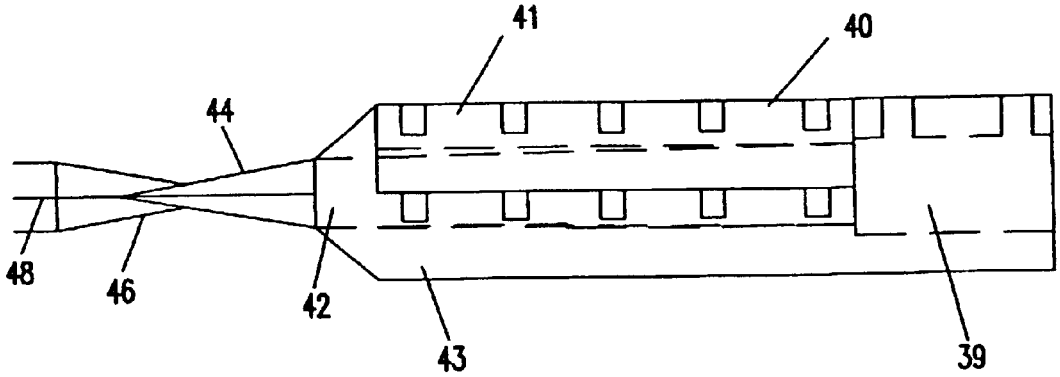
FIG. 4 shows a side view of a preferred embodiment of the substrate holder of the invention.

Referring to FIGS. 4 and 5, gripper carrier 40 includes a chamber 42 (shown in hidden lines in FIG. 4) for receiving the substrate gripper 44. Chamber 42 is sized and configured to receive substrate gripper 44 and frictionally engage the substrate gripper 44 in place during operation. In one preferred embodiment shown in FIG. 4, the gripper carrier 40 is provided in two parts 41 and 43 that can be assembled to receive the substrate gripper 44. This two-part configuration of the gripper carrier 40 allows the operator to remove part 41 of the gripper carrier 40 to insert or remove substrate gripper 44 by opening the chamber 42 and laying the substrate gripper 44 within the chamber, then replacing the part 41 in position to thereby confine the substrate gripper 44. Parts 41 and 43 can be held together using any suitable connector mechanism, including screws, pins, clamps, or the like. Alternatively, the parts 41 and 43 are magnetized, so that the parts are held together by magnetic force. In an alternative embodiment, gripper carrier 40 is configured as a one-piece assembly, and the substrate gripper 44 is simply inserted into the chamber 42 through the end opening of the chamber, until it is frictionally held in place.

Preferably, substrate gripper 44 is provided in the form of tweezers or other suitable grasping and holding device. Optionally, the substrate gripper 44 is used in connection with a collar 46 that slidably fits around the outer surface of the substrate gripper 44 once a substrate 48 has been provided within the substrate gripper 44. As shown in FIG. 4, in use, a substrate 48 is grasped with the substrate gripper 44. Collar 46 is then slipped around the outer surface of substrate gripper 44. Collar 46 thus provides a splashguard to keep the coating solution from coating and building up on the substrate gripper 44. Collar 46 also preferably provides additional stabilization of the gripper/substrate engagement. Once the collar 46 has been seated on the substrate gripper 44, the substrate gripper 44 is inserted into the gripper carrier 40 until the substrate gripper 44 is seated within the chamber 42.

The substrate gripper 44 is preferably held within chamber 42 of the gripper carrier 40 by frictional force, and the connection can be reinforced using any suitable connecting device, such as screws, magnets, pins, clamps, or similar coupling mechanism.

Figure 9:
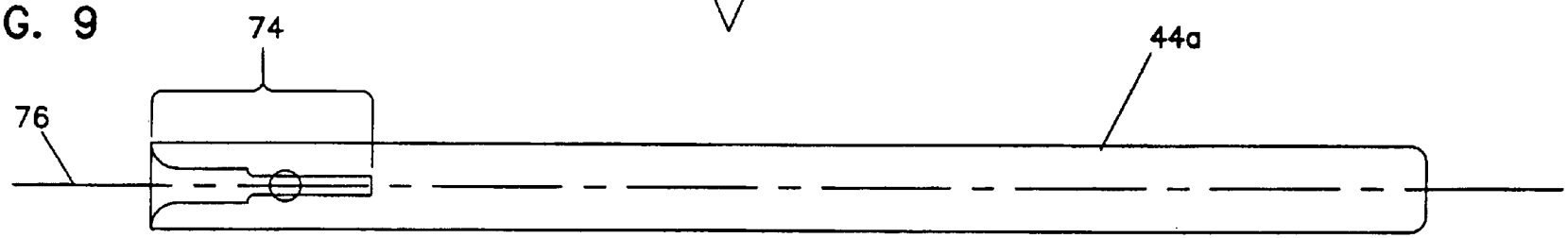
FIG. 9 shows a side view of an alternative embodiment of the substrate gripper of the invention.

Referring to FIG. 9, an alternative embodiment of the substrate gripper 44 of the invention is shown. As shown in the figure, substrate gripper 44*a* comprises a unitary holder that includes a collar portion 74. Preferably, the collar portion comprises a flared portion of the substrate gripper 44*a*, to allow easy insertion of a pin 76. In the embodiment shown in the figure, the entire substrate gripper 44*a* comprises one piece. The substrate gripper 44*a* can be fabricated by taking a rod, such as a metal rod (e.g., stainless steel), and forming a chamber in one end, for example, by drilling. A collar portion 74 can be cut out of the rod, for example, using an auger. Once a chamber has been drilled into the end of the rod, a pin 76 is inserted into the formed chamber. The pin 76 can comprise any suitable material and is preferably Teflon™. Pin 76 is held within substrate gripper 44*a* in a sufficiently stable manner and can be secured using any mechanism, including adhesive, pins, screws, and the like. Pin 76 is inserted into the substrate gripper 44*a* through the collar portion 74 and is seated within the chamber or hole contained within the substrate gripper 44*a*.

Once the substrate gripper 44*a* is assembled, a substrate to be coated, such as a stent, is seated onto pin 76. This embodiment of the substrate gripper 44*a* can be used with the gripper carrier 40 described above.

In one preferred embodiment, the substrate mounts 9 are rotatable about radial axes 27 (shown in FIG. 2) that are perpendicular to the central axis 29 of the wheel, as discussed in more detail below.

Figure 10:
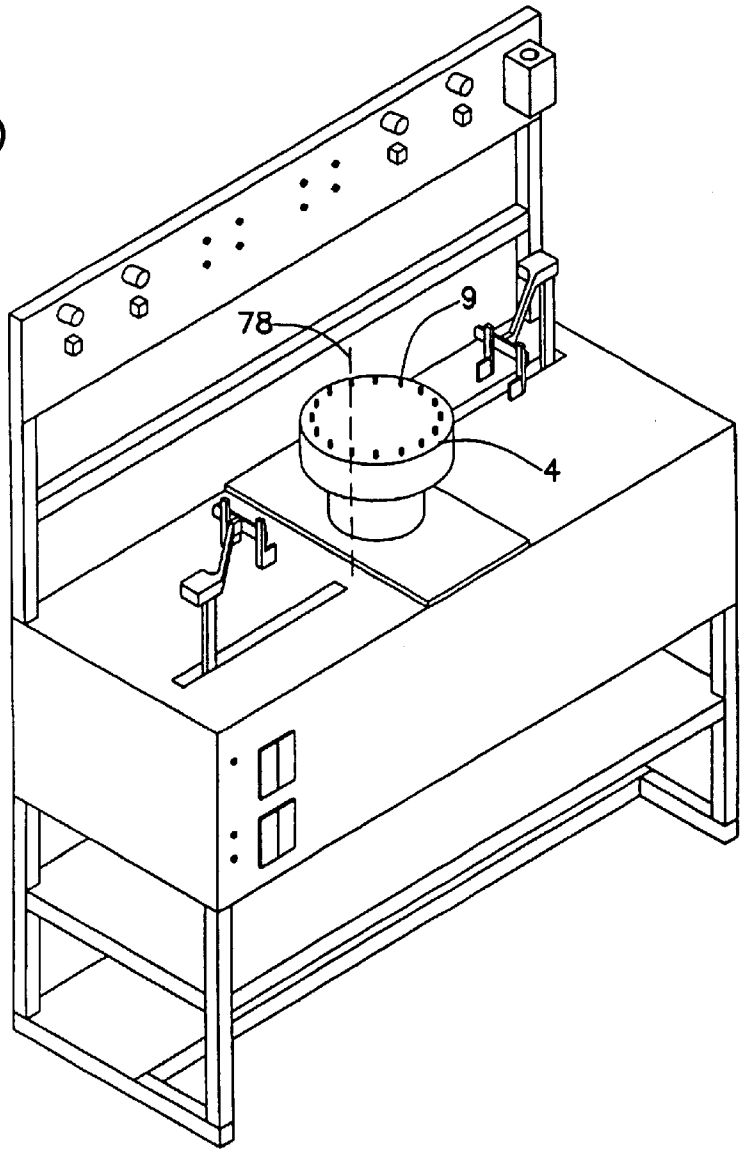
FIG. 10 shows a perspective view of an alternative embodiment of the device of the invention.

In an alternative embodiment, the substrate mounts 9 rotate about second axes that are parallel to the central axis. As shown in FIG. 10, substrate mounts can be rotatable about second axes 78. In the embodiment shown, the substrate mounts 9 are positioned on the upper face of the wheel 4 and are provided in a vertical position. It is understood that the substrate mounts 9 could alternatively be positioned on the downward face of the wheel, in which case the substrate mounts would still be rotatable about second axes 78. Preferably, when using this embodiment of the rotation member, the solvent used for the coating solution flashes off quickly, so that uneven application of the coating onto the substrates can be minimized or avoided. One such solvent is tetrahydrofuran, for example.

While the substrate mounts 9 have been described as being positioned at the periphery of the rotation member, it is understood that the substrate mounts can be positioned at any suitable location on the rotation member, to allow deposition of a coating solution using the invention described herein.

Drive Arrangement

According to the invention, the device further includes a drive arrangement for rotating the rotation member about a central axis and for rotating the substrate mounts about second axes. In one embodiment, the device includes a first drive arrangement for rotating the wheel 4 about the central axis 29 and for rotating the substrate mounts 9 about the radial axes 27 (see FIG. 2). As shown in FIG. 6, one embodiment of the drive arrangement includes a first (e.g., rotation member) drive arrangement and a second (e.g., substrate mount) drive arrangement. The configuration shown allows independent rotation of the wheel 4 about the central axis 29 and of the substrate mounts 9 about the radial axes 27. In a preferred embodiment, the rotation member drive arrangement includes motor 62 (e.g., an electric motor such as a megatorque motor sold by NSK Ltd, Precision Machinery and Parts Tech Center, Gunma-Ken, Japan). The wheel 4 is preferably mounted on or otherwise fastened to a rotor 60 of the motor 62. Rotation of the rotor 60 by motor 62 thus causes rotation of the wheel 4.

Figure 3:
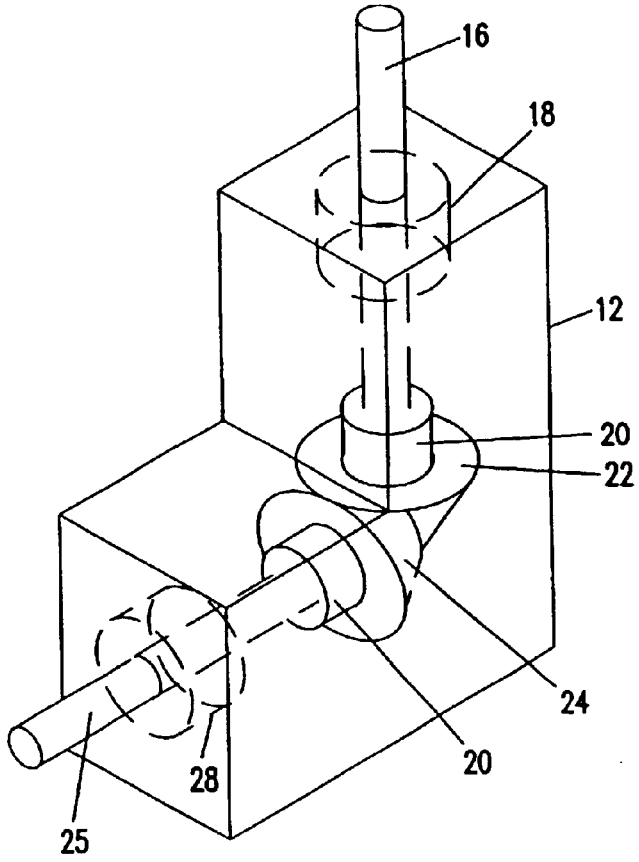
FIG. 3 shows a side view of a preferred embodiment of the right angle drive of the invention.

As shown in FIGS. 2, 3 and 6, a preferred embodiment of the substrate mount drive arrangement includes a vertical drive shaft 6, a plurality of right angle drive mechanisms 12, and a continuous drive belt 8 that engages the vertical drive shaft 6 and the right angle drive mechanism 12. Referring to FIG. 6, the vertical drive shaft 6 preferably passes through a central channel 64 defined by the motor 62, and into the wheel 4, where the vertical drive shaft includes center pulley 90. Preferably, vertical drive shaft 6 is coupled via coupler 66 to a motor 70 to provide rotation of the vertical drive shaft 6. Bearings 68 can be provided to stabilize the vertical drive shaft 6 within the wheel 4. At its top, vertical drive shaft 6 includes center pulley 90.

The vertical drive shaft 6 of the drive arrangement is coupled at one end to the motor 70 and engages the drive belt 8 at its other end (e.g., at pulley 90). The vertical drive shaft 6 thus translates movement from the motor 70 to the drive belt 8 for rotation of the substrate mounts 9 about the radial axes 27. Any suitable motor can be used with the invention, and the type of motor is not considered critical to the invention. Preferably, the motor is a DC motor, such as an FBL Series II Brushless DC Motor, with 5:1 bear box (available from Oriental Motor, Torrance, Calif.). Another exemplary motor is a stepper servo AC motor.

Referring to FIGS. 2 and 3, right angle drive mechanisms 12 are positioned around the periphery of the wheel. Referring now to FIG. 3, each right angle drive mechanism 12 preferably includes pulley 14 located on top of a right angle drive 12 in the interior of the wheel 4. In a preferred embodiment, each right angle drive 12 further includes a vertical shaft 16 that is connected to the pulley 14, a gear mechanism 20 coupled to the vertical shaft 16, and a horizontal shaft 25 coupled to the gear mechanism. Each right angle drive preferably further includes bearings 18 and 28 for stability of the drive mechanism. Other stabilizing mechanisms can be provided as desired. Preferably, the gear mechanism 20 comprises a pair of gears 22 and 24, shown as bevel gears in FIG. 3. Other gear mechanisms can be substituted for the bevel gears shown to achieve the desired coupling of the vertical shaft 16 and horizontal shaft 25 and translation of rotational movement as described herein.

Referring now to FIG. 2, drive belt 8 is stretched around the center shaft pulley 90 of drive shaft 6 and loops around each pulley 14 of the right angle drives 12 of the wheel 4. Drive belt 8 is driven by vertical drive shaft 6, which is driven by a drive motor 70. The drive belt 8 also engages pulleys 14 of right angle drives 12 for translation of the rotational movement of the vertical drive shaft 6 about the axis 29 to the rotational movement of substrate mounts 9 about their corresponding radial axes 27. Preferably, in use, drive belt 8 selectively engages and disengages the center shaft pulley 90 and pulleys 14 during rotation of the respective component. For example, during rotation of the rotation member about the central axis 29, drive belt 8 can selectively disengage pulleys 14, to allow rotation of the rotation member without rotation of the substrate mounts. Alternatively, during the coating process, drive belt 8 can selectively disengage vertical shaft 6 to allow rotation of the substrate mounts about second axes, without attendant rotation of the rotation member about the central axis 29.

In one preferred embodiment, drive belt 8 is provided as a two-sided timing belt. However, one of skill in the art would readily appreciate that other suitable drive belts can be used in the invention to achieve the desired result. For example, any mechanism for transferring torque is contemplated, such as mechanisms employing belts, teeth, pulleys, or frictional devices. Examples of suitable drive mechanisms include belts, O-rings, gears, chains, sprockets, and the like.

The substrate mount drive arrangement preferably further includes a belt tensioner 10 to maintain adequate tension in the drive belt 8. As shown in FIG. 2, the belt tensioner 10 is preferably provided in a half moon configuration and is slidably mounted on the wheel 4 through slots 11 for movement relative to the wheel 4 to tighten or loosen the belt 8. One of skill in the art would appreciate that belt tensioner 10 could be provided in a variety of configurations to achieve the desired result.

Referring to FIGS. 2 and 5, rotation of the substrate mounts 9 about radial axes 27 is achieved by the substrate mount drive arrangement. Preferably, the radial axes 27 are arranged perpendicular to the central axis 29. As discussed above, vertical drive shaft 6 drives movement of drive belt 8, which in turn drives movement of pulleys 14. Pulleys 14 are attached to the vertical shafts 16 of the right angle drive 12. Thus, rotation of the pulleys 14 by the belt 8 causes rotation of the vertical shafts 16, which in turn cause rotation of the horizontal shafts 25. The horizontal shaft 25 of right angle drive 12 is coupled to the substrate mounts 9 of the device. Therefore, rotation of the shafts 25 about the radial axes 27 causes the substrate mounts 9 to rotate about the radial axes 27. Preferably, the drive belt 8 is disengaged from contact with the pulleys 14 when the rotation member is rotated, and rotation of the substrate mounts 9 is not desired.

One embodiment of the coupling mechanism for coupling the horizontal shaft 25 of the right angle drive 12 to the substrate mount 9 is shown in FIGS. 2 and 5. As shown, the wheel 4 includes a peripheral rim area 30 that is located outwardly from the right angle drive 12 and within the interior of the wheel 4. Peripheral rim area includes pocket 32. Horizontal shaft 25 projects from right angle drive 12 and is coupled via coupler 34 to shaft 26 of the substrate mount 9. Shaft 26 projects through the pocket 32 of the peripheral rim area 30, where it is preferably provided with bearings 36 for stabilization.

Referring to FIG. 5, the right angle drive 12 with projecting vertical shaft 16 and horizontal shaft 25 is shown. Horizontal shaft 25 is coupled through coupler 34 to the shaft 26 of substrate mount 9 within the interior of the wheel 4. As shaft 26 of the substrate mount 9 passes through the pocket 32 of peripheral rim area 30, it is preferably stabilized by bearings 36. The bearings 36 are optionally provided to stabilize the shaft 26 of substrate mount 9 as it passes through the periphery of the wheel and projects outwardly therefrom. In operation, movement of pulley 14 causes rotation of vertical shaft 16 of the right angle drive, which in turn causes movement of gear mechanism 20 (FIG. 3) which translates movement of vertical shaft 16 to movement of horizontal shaft 25. Rotation of horizontal shaft 25 in turn causes rotation of substrate mounts 9 about their radial axes.

In an alternative embodiment, when the rotatable member is rotated about the central axis, and the substrate mounts are rotated about second axes that are parallel to the central axis (e.g., as shown in FIG. 10), substrate mount 9 is coupled to pulley 14 to provide rotational movement about vertical axes 78. In this embodiment, the right angle drive 12 is not required.

Substrate mounts 9 are rotated at a suitable speed to achieve the desired coating uniformity, and the speed will depend upon such factors as the viscosity of the coating solution and the surface geometry of the substrate. Typically, the substrate mounts 9 are rotated about their radial axes at a rate of approximately 50 rpm (revolutions per minute) to approximately 500 rpm, preferably about 100 rpm.

As shown in FIG. 6, motor 70 is preferably mounted to a platform 65, and rotation member motor 62 is mounted to platform 65 as well. In one embodiment, shown in the figure, the motor 70 is mounted on an opposite face of platform 65 from rotation member motor 62. Motor 70 thus drives rotation of drive shaft 6, which in turn causes rotation of center pulley 90 to cause radial rotation of substrate mounts 9.

Coating Station

Figure 7:
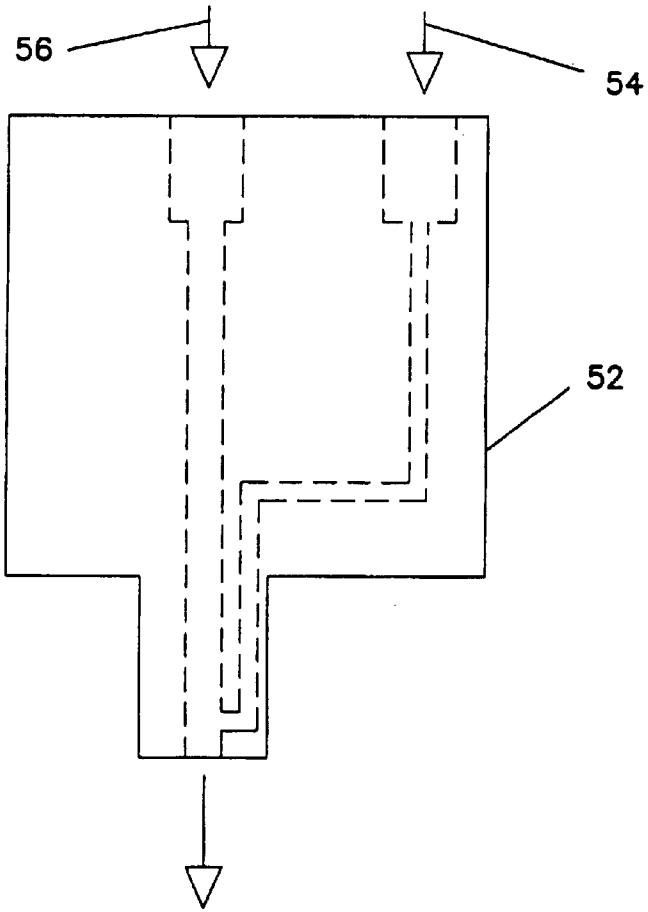
FIG. 7 shows a cross-sectional view of a preferred nozzle of the invention.

Preferably, the invention further includes at least one coating station for application of a coating on the substrate. As shown in FIG. 1, the coating station 2 is provided in spaced relation to the projecting substrate mounts 9 around the wheel 4. Preferably, the coating station is adjacent to the rotation member. As used herein, "adjacent" means in sufficient proximity to allow the coating station to apply coating solution to substrates mounted onto the rotation member. Thus, this distance will be adjusted depending upon such factors as the dimensions of the coating station and rotation member, as well as dimensions of the substrates to be coated. Referring to FIG. 7, the coating station 2 includes a nozzle 52 and a solution delivery channel 54 (e.g., a conduit, tube, passage, or the like) for delivery of a coating solution from a solution source (not shown) to the nozzle 52. Optionally, the coating station further includes a gas delivery channel 56 for delivery of gas from a gas source (not shown) to the nozzle 52. The solution delivery channel 54 and gas delivery channel 56 can be provided as separate channels that are joined within the nozzle 52, so that the gas and solution are delivered from the nozzle through a single opening.

Preferably, the gas is inert, such as nitrogen. The gas preferably atomizes the coating solution. The gas is provided at sufficient pressure to provide good atomization to shear the solution on the surface of the substrate. Preferably, the gas delivery channel supplies the gas to the same nozzle that is used for delivery of the coating solution, although a separate gas delivery nozzle could also be used with the invention.

An example of a suitable nozzle is commercially available from Ivek Corporation (North Springfield, Vt.) under catalog number 191.2.

Preferably, the coating station comprises a movable arm to allow movement of the coating station into proximity to the substrate during application of the coating, and out of proximity when coating solution is not provided to the nozzle. In a preferred embodiment, the arm of the coating station is movable in both the X and Y axes, providing vertical and horizontal movement of the nozzle.

In the preferred embodiment shown in FIG. 1, the coating station 2 is movable in a direction of arrows 3 and 3', which is toward and away from the rotation member 4, respectively. Movement of the entire coating station provides the ability to remove the nozzle from the coating zone when coating is not being applied to the substrate, for cleaning or other operations. Once the coating operation is in use, the coating station is moved into the coating zone and the solution is supplied.

In the embodiment shown in FIG. 1, two coating stations 2 are provided around the periphery of wheel 4. As shown in this embodiment, the two coating stations are opposite each other, one on each side of the wheel 4. Spacing of the coating stations can be varied by the user as desired, in light of space considerations and coating methods. When two or more coating stations are used, they are preferably spaced a sufficient distance apart to allow spray deposition without cross-contamination of coating solution from station to station. In one preferred embodiment shown in FIG. 1, the invention is configured on a benchtop so that it is easily used within a standard fume hood of a laboratory.

The embodiment shown in the figures includes two sets of nozzles in each coating station. However, it is contemplated that any number of nozzles can be provided in connection with each coating station, and the number of nozzles will be determined by the configuration of the rotation member, and the positioning of the substrates on the rotation member.

According to the invention, the vertical position of the coating station is controlled so that the space between the substrate and the nozzle is maintained at a constant, predetermined distance. The coating deposition area is limited to minimize waste.

As used herein, "coating zone" will refer to an area surrounding the substrate 48 to be coated that is defined by the area of solution sprayed over and around the substrate. The coating zone is limited by such factors as the relative positions of the nozzle and substrate, movement of the nozzle, diameter of the nozzle, amount of atomization of the solution, the distance between the nozzle and substrate, and the speed of solution delivery from the nozzle. For example, in a first axis, the coating zone is defined by such factors as the relative vertical positions of the nozzle and substrate. In a second axis, the coating zone is defined by such factors as the diameter of the nozzle 52, the speed of the solution delivery from the nozzle, and the length of the substrate 48 to be coated (and thus the distance the movable arm of the coating station travels during application). Optimizing the coating factors will allow one to achieve the desired coating with minimal reagent waste.

Preferably, the invention is used in connection with spray deposition, although other deposition may be used in connection with the invention. Alternatively, the substrates could be passed under or through a coating solution stream, or coating can be provided to the substrate or a section of the substrate through a needle or the like.

Method

Generally, the coating operation of the invention is performed by rotating or indexing the rotation member to position the substrates in proximity to a coating station, rotating the substrate mounts about the second (e.g., radial) axes, thereby rotating the substrates, and supplying coating solution through the nozzle at a sufficient rate and direction to apply a substantially uniform coating while the substrates are rotating about the second axes.

The method according to the invention includes steps of: (a) providing a device that includes (i) a rotation member rotatable about a central axis, (ii) a plurality of substrate mounts positioned on the rotation member that are rotatable about second axes, and (iii) a drive arrangement for rotating the rotation member about a central axis and rotating the substrate mounts about second axes; (b) mounting a substrate onto the substrate mounts; (c) providing at least one substrate coating station adjacent to the rotation member; (d) rotating the rotation member about the central axis to position one or more of the substrate mounts at the substrate coating station; (e) supplying the coating through the nozzle; (f) moving the nozzle of the coating station in a direction parallel to the substrate to form a uniform coating on the substrate; and (g) rotating the substrate mounts about second axes during the supplying and moving steps.

Preferably, a gas is provided through gas delivery channel to the nozzle 52 (FIG. 1) simultaneously with the flow of coating solution. In a preferred embodiment, the gas is an inert gas, such as nitrogen. The gas is provided at suitable pressure, for example from 1 to 50 psi (pounds per square inch), to sufficiently atomize the solution on the surface of the substrate. The rate of delivery of the solution is adjusted to provide a suitable thickness of coating on the surface of the substrate, for example, 600 $\mu$g per $cm^2$.

Preferably, when gas is provided with the solution, the gas supply is continued before and after supply of the solution through the nozzle. This allows cleaning of the nozzle prior to solution application and some drying of the coating after the solution is applied to the substrate, although this step is not required. Additionally, supply of the solution can be started before the nozzle reaches the coating zone, to purge an amount of the solution prior to applying the solution to the substrate, when desired.

In a preferred embodiment, the distance between the nozzle and the substrate is maintained at a constant, predetermined distance, for example, approximately 2 cm to approximately 10 cm, preferably about 4 cm to about 6 cm.

When solution is supplied through the nozzle, the nozzle forms a spray deposition pattern of a diameter approximately 0.5 to approximately 2 cm, preferably about 1 cm. The diameter of the spray deposition pattern will vary depending upon the nozzle used.

The delivery rate of the solution through the nozzle is preferably about 5 μμl per second to about 30 μl per second, more preferably about 10 μl to about 20 μl per second when the viscosity of the solution is about 1 centipoise (cp). As used herein, the "delivery rate" refers to the rate at which the coating solution is supplied through the nozzle. The delivery rate of the coating solution can be adjusted depending upon such factors as the viscosity of the coating solution, and the solvent system used with the coating solution. For example, when a solvent such as tetrahydrofuran (THF) is used, which flashes off substrates quickly, the delivery rate can be increased, whereas when a solvent such as water is used, a slower delivery rate is used.

In use, the nozzle 52 is positioned at position 50, shown in FIG. 1, wherein the coating station is moved in a direction of arrow 3' to a position away from a coating zone. Preferably, nozzle 52 is brought in contact with a cleaning solution or other solution to remove any residual coating solution from the nozzle and to prevent dehydration of the nozzle, while substrate to be coated is mounted onto the rotation member 4. Subsequently, coating solution is supplied from a solution source (not shown) and through solution delivery channel 54 (FIG. 7) to nozzle 52 as the nozzle is moved in the direction of arrow 3 toward the coating zone. Preferably, a gas is supplied from a gas source (not shown) through gas delivery channel 56 (FIG. 7) to nozzle 52 to atomize the coating solution to shear the solution on the substrate surface. Supply of the coating solution, and gas if desired, is preferably started before the nozzle reaches the coating zone, so that the nozzle is purged to rid the nozzle of any unwanted debris or dried coating solution.

Once the nozzle 52 reaches the coating zone, the coating solution is applied to the substrate in a sweeping, back and forth manner. The nozzle continues to travel along the axis parallel to the substrate and along the direction of arrows 3 and 3', along the length of the substrate to be coated. The nozzle completes one coating "shot" by completing one back and forth coating motion along the length of the substrate. Multiple shots can be applied to the substrate as desired, and the number of shots applied to the substrate is adjusted to achieve the desired coating weight.

The volume of coating solution applied for each shot can be adjusted depending upon such factors as the solvent system used and the viscosity of the coating solution. Typically, for a coating solution using THF as a solvent, the coating solution is applied in approximately 50 μl to approximately 70 μl shots, preferably approximately 50 μl to approximately 65 μl shots. For this shot volume, typically three shots will be applied to the substrate in one coating application.

The coating station can be adjusted so that there is a delay between shots of the coating solution onto the substrate. The length of delay between shots depends upon such factors as the shot volume and the length of time required to dry the coating solution before applying additional coating solution. Typically, a delay of approximately 2 seconds to approximately 10 seconds, preferably about 4 seconds to about 6 seconds is preferred for a shot volume of approximately 65 μl, when the coating solution comprises a THF solvent system.

The above parameters are exemplary only and can be adjusted to achieve the desired coating thickness and characteristics desired, while minimizing waste of the coating solution.

After the coating solution is applied, the nozzle 52 is moved to position 50. Once the nozzle has cleared the coating zone, the solution delivery and gas delivery, when desired, are shut off to avoid waste of the materials. Alternatively, the gas delivery is kept on while the nozzle is returning to position 50, to improve drying of the coating, when desired. The point at which the solution and gas delivery are turned on and off are not considered critical to the invention.

Once the nozzle is moved back to position 50, the rotation member 4 is advanced to position the next substrate or substrates to be coated by the coating station. When multiple coating stations are provided in association with the rotation member 4, stepwise rotation of the rotation member positions the substrates within multiple coating zones for coating with multiple coating solutions. The rotation member is rotated stepwise until all stents are properly coated. The coating application is repeated until all of the loaded substrates have been coated; i.e., one full revolution of the rotation member 4 about its central axis 29.

A program control can be provided to allow required adjustments and monitoring of conditions of coating to achieve desired coating thickness.

When coating stents, only the portion of the stent projecting radially from the substrate gripper 44 will be coated, for example, using the embodiment shown in FIG. 4. When it is desired to coat the entire surface of the stent, the stents are removed from the rotation member by an operator, inverted, and reinserted into the rotation member so that the other half of the stent (the uncoated portion of the stent) is projected radially from the rotation member and is thereby coated. The coating operation is repeated for the second half of the stent.

The duration of a coating cycle will depend upon the number of substrates loaded onto the rotation member, as well as the number coating stations and the type of coating applied. Typically, substrate mounts are positioned approximately 10 cm to approximately 20 cm apart. The distance separating the substrate mounts can be adjusted depending upon the geometry of the substrates to be coated, the speed of the coating, the coating solution, and the like. Additionally, the use of any drying or curing stations will affect the duration of a coating cycle. Typically, the duration of a coating cycle will be in the range of 3 minutes to 2 hours.

When the substrate mounts 9 project vertically from wheel 4 as shown in FIG. 10, the coating station movement is adjusted to move vertically in a direction parallel to the substrate. The coating solution is applied in a sweeping, up and down manner. The nozzle continues to travel along the axis parallel to the substrate along the length of the substrate to be coated.

In a preferred embodiment, the invention includes a stepping advance of the rotation member. Thus, for example, when the rotation member carries 20 substrates, and two substrates are coated by one coating station, the rotation member will make 10 steps per revolution. At least one full revolution is performed for a coating operation.

As a result of the arrangement and rotation of components, the invention provides a combination of such advantages as efficiency, reduction of human factors in the coating operation, and uniform coating of substrate. The invention provides an improved device and method for coating medical devices, particularly medical devices having surface geometries that are otherwise difficult to uniformly coat. Moreover, a large number of substrates can be coated, and a plurality of coating layers can be applied to each substrate, in a relatively short period of time.

The invention can accommodate a variety of substrates of different configurations. The gripper carrier can be modified to carry different substrates. The gripper carrier can then be mounted onto the rotation member via standard sized substrate mounts.

Radial or axial displacement of the substrates is reduced by the configuration of the gripper carrier mounted onto the substrate mounts. Also, bearings included in the rotation member stabilize the substrate mounts, further reducing any movement of the mounted substrates.

Optionally, illumination stations including a light-exposure device can be provided if a photoreactive coating is applied such as those described in U.S. Pat. No. 5,637,460 ("Restrained Multifunctional Reagent for Surface Modification," Swan et al.) and U.S. Pat. No. 5,714,360 ("Photoactivatable Water Soluble Cross-Linking Agents Containing an Onium Group," Swan et al.) (commonly assigned to the present Assignee, the disclosures of which are incorporated by reference) or one or more heating stations can be provided if thermal curing of the coating is required.

EXAMPLE 1

Coating Cardiovascular Stents

A preferred method of the invention is performed by way of the example as follows. Cardiovascular stents of length approximately 15–20 mm were inserted into substrate grippers and a collar was slid over the juncture between the substrate gripper and stent. The substrate gripper, stent and collar were then inserted into a chamber formed in the gripper carrier. The substrate gripper was inserted into the gripper carrier and pushed until the substrate gripper seated into the chamber of the gripper carrier and was frictionally held in place. The gripper carrier was then mounted onto shaft of the substrate mount of the device. The desired number of stents were mounted onto wheel 4 as shown in FIG. 1.

Once the desired number of stents were mounted onto the wheel, the wheel was rotated about its central axis to bring two stents into a first coating zone. In this example, the first coating zone is defined as being positioned within proximity to coating station 2 shown in FIG. 1. Once the stents were positioned as shown in FIG. 1, a coating cycle was started.

A 5 mg/ml coating solution comprising 30% by weight drug, 35% by weight poly(ethylene-co-vinyl acetate) (PEVA) and 35% by weight poly(butylmethacrylate) (PBMA) in THF as described in PCT Publication Number WO 99/55396 (International Application Number PCT/US99/08310, Chudzik et al., commonly assigned to the assignee of the present invention and incorporated herein by reference) was provided through the solution supply channel of the coating station from a solution source to the nozzle. During the coating operation, the nozzle was moved in a direction parallel to the stent, shown as arrows 3 and 3' in FIG. 1. The speed of movement of the nozzle is typically about 6 mm per second. The coating solution pump was adjusted to provide a solution delivery rate of 20 $\mu$l per second to the stent surface. According to the invention, the nozzle was moved along the axis parallel to the stent a sufficient number of times to apply suitable coating thickness. Ten (10) shots (e.g., passes of the nozzle), with each shot being one trip back and forth along the length of the stent, were applied, each shot equaling 51 $\mu$l–67 $\mu$l of coating solution. A delay of four (4) seconds was provided between each coating shot.

The distance from the nozzle to the stent was adjusted to minimize waste of the coating solution and provide a coating to the surface of the stent. The distance from nozzle to stent was 4.5 cm. Nitrogen, $N_2$, was provided at a rate of 4 psi.

Simultaneously with the application of the coating, the substrate mounts were rotated at a constant rate about radial axes at a speed of 100 rpm to allow uniform application of the coating.

Once sufficient coating solution was applied, the solution supply channel was shut off and the nozzle was moved out of the coating zone. Nitrogen supply was continued after the solution supply was cut off, to allow cleaning of the nozzle and some extent of drying of the coating.

The above application of a coating of approximately 4 $\mu$m–6 $\mu$m thickness to the stent is referred to as a coating application. Once a coating application was performed, the wheel was rotated sequentially to position the next two stents in the coating zone for coating application. Rotation of the wheel positions stents sequentially through coating stations for application of multiple coatings. The wheel was rotated stepwise until all stents were properly coated.

Once the wheel completed a coating application, the stents were removed from the substrate mounts, inverted, and re-mounted onto the wheel so that the other half of the stents (uncoated) projected radially from the wheel. The coating application was repeated to coat the second half of the stents. Stents were removed and weighed to determine coating thickness. Results are shown in Table I below.

TABLE I

| | Stent A | Stent B | Stent C | Stent D | Average |
|---|---|---|---|---|---|
| First half | 271 $\mu$g | 301 $\mu$g | 289 $\mu$g | 291 $\mu$g | 288 ± 12.5 $\mu$g |
| Second half | 282 $\mu$g | 309 $\mu$g | 286 $\mu$g | 303 $\mu$g | 295 ± 13.0 $\mu$g |

The results show a substantially uniform coating thickness when the invention is used to apply a coating on stents.

The invention has been described with reference to various specific and preferred embodiments and techniques. However, it will be apparent to one of ordinary skill in the art that many variations and modifications may be made while remaining within the spirit and scope of the invention. While the invention has been described in relation to coating stents, one of skill in the art would readily appreciate the applicability of the invention to a variety of substrates.

All publications and patent applications in this specification are herein incorporated by reference to the same extent as if each individual publication or patent application was specifically and individually incorporated by reference.

We claim:

1. A method of applying a substantially uniform coating on a substrate comprising steps of:

a. providing a device for holding a substrate, the device comprising:
   i) a rotation member rotatable about a central axis;
   ii) a plurality of substrate mounts positioned on the rotation member, the substrate mounts being rotatable about second axes; and
   iii) a drive arrangement for rotating the rotation member about the central axis and rotating the substrate mounts about the second axes;

b. mounting the substrate onto the substrate mounts;

c. providing at least one substrate coating station adjacent to the rotation member, the substrate coating station comprising a nozzle for application of the coating to the substrate;

d. rotating the rotation member about a central axis to position one or more of the substrate mounts at the substrate coating station;

e. supplying the coating through the nozzle;

f. moving the nozzle of the coating station in a direction parallel to the substrate at a predetermined rate to apply a uniform coating on the substrate; and g. rotating the substrate mounts about second axes simultaneously with steps e) and f).

2. The method according to claim 1 wherein the step of rotating the substrate mounts about second axes simultaneously with steps e) and f) comprises rotating the substrate mounts about radial axes that project radially outward from the central axis.

3. The method according to claim 1 wherein the step of rotating the substrate mounts about second axes simultaneously with steps e) and f) comprises rotating the substrate mounts about axes that are parallel to the central axis.

* * * * *